US008726858B2

(12) United States Patent
Hiyoshi et al.

(10) Patent No.: US 8,726,858 B2
(45) Date of Patent: May 20, 2014

(54) VARIABLE COMPRESSION RATIO INTERNAL COMBUSTION ENGINE

(71) Applicant: Nissan Motor Co., Ltd., Kanagawa (JP)

(72) Inventors: Ryosuke Hiyoshi, Isehara (JP); Yoshiaki Tanaka, Fujisawa (JP); Yusuke Takagi, Hadano (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 13/856,204

(22) Filed: Apr. 3, 2013

(65) Prior Publication Data

US 2013/0306036 A1 Nov. 21, 2013

(30) Foreign Application Priority Data

May 18, 2012 (JP) ..... 2012-114036

(51) Int. Cl.
*F02B 75/04* (2006.01)

(52) U.S. Cl.
USPC ..... 123/48 R; 123/78 R; 123/78 F

(58) Field of Classification Search
USPC ..... 123/48 R, 78 R, 78 F
See application file for complete search history.

(56) References Cited

U.S. PATENT DOCUMENTS

| | | | | |
|---|---|---|---|---|
| 6,691,655 | B2 * | 2/2004 | Aoyama et al. | 123/90.16 |
| 6,920,847 | B2 | 7/2005 | Hiyoshi et al. | |
| 7,334,547 | B2 * | 2/2008 | Hiraya et al. | 123/48 R |
| 7,681,538 | B2 * | 3/2010 | Hiyoshi et al. | 123/48 B |
| 7,753,013 | B2 * | 7/2010 | Hiyoshi et al. | 123/78 E |
| 8,397,683 | B2 * | 3/2013 | Hiyoshi et al. | 123/48 B |
| 2001/0039929 | A1 * | 11/2001 | Arai et al. | 123/48 R |

FOREIGN PATENT DOCUMENTS

JP 2004-257254 A 9/2004

* cited by examiner

*Primary Examiner* — Marguerite McMahon
*Assistant Examiner* — James Kim
(74) *Attorney, Agent, or Firm* — Global IP Counselors, LLP

(57) ABSTRACT

A variable compression ratio internal combustion engine basically has a main engine body and a variable compression ratio mechanism. A housing is attached to an outside wall of the main engine body to support an actuator. The variable compression ratio mechanism varies an engine compression ratio according to a rotational position of a first control shaft by the actuator. A second control shaft links the actuator to the first control shaft. A bearing includes a pair of split bearing bodies that rotatably holds and supports the second control shaft on the housing. The split bearing body that is farther from the main engine body has higher in rigidity than the housing. The bearing is fixed to the side wall of the main engine body by fixing bolts that pass through both of the split bearing bodies and thread into the side wall of the main engine body.

20 Claims, 7 Drawing Sheets

VARIABLE COMPRESSION RATIO INTERNAL COMBUSTION ENGINE

CROSS-REFERENCE TO RELATED APPLICATIONS

This application claims priority to Japanese Patent Application No. 2012-114036, filed on May 18, 2012. The entire disclosure of Japanese Patent Application No. 2012-114036 is hereby incorporated herein by reference.

BACKGROUND

1. Field of the Invention

The present invention generally relates to a variable compression ratio internal combustion engine. More specifically, the present invention relates to a variable compression ratio internal combustion engine having a variable compression ratio mechanism capable of varying an engine compression ratio.

2. Background Information

A variable compression ratio mechanism has been previously proposed for varying an engine compression ratio by using a multiple-link piston crank mechanism (see, for example, Japanese Laid-Open Patent Publication No. 2004-257254). Such a variable compression ratio mechanism is configured to control the engine compression ratio according to an operating state of the engine by varying a rotational position of a first control shaft via a motor or another actuator.

SUMMARY

It has been discovered that in the case of a variable compression ratio mechanism having an actuator that is disposed outside of the main engine body to protect the actuator from oil, exhaust heat, or the like, the actuator and a first control shaft are linked by a linking mechanism. In such a structure, the first control shaft is disposed inside the main engine body and a second control shaft of the linking mechanism is disposed outside the main engine body. The first control shaft and the second control shaft are linked by a lever passing through a side wall of the main engine body. The second control shaft is accommodated and disposed inside a housing attached to the side wall of the main engine body, and a motor or another actuator is attached to this housing.

With such a structure, there is a need for a smaller housing because of the need to dispose components such as the housing and the actuator in a limited installation space in the vicinity of the side walls of the main engine body. Additionally, the housing should have a high supporting rigidity for rotatably supporting the second control shaft.

In view of the state of the known technology, one aspect of the present disclosure is to provide a variable compression ratio internal combustion engine that basically comprises a main engine body, a housing, an actuator and a linking mechanism. The housing is attached to a side wall of the main engine body. The variable compression ratio mechanism is configured to vary an engine compression ratio according to a rotational position of a first control shaft that is rotatably disposed inside the main engine body. The actuator is disposed outside of the main engine body and is configured to vary and maintain the rotational position of the first control shaft. The linking mechanism links the actuator to the first control shaft. The linking mechanism is least partially disposed outside of the main engine body and includes a second control shaft rotatably supported to the housing by a bearing to rotate in conjunction with the first control shaft. The bearing includes a pair of split bearing bodies having a halved structure that rotatably holds the second control shaft therebetween. At least the split bearing body that is farther from the main engine body being configured as a separate member that is higher in rigidity than the housing. The bearing is fixed to the side wall of the main engine body by fixing bolts that pass through both of the split bearing bodies and thread into the side wall of the main engine body.

Accordingly with the disclosed variable compression ratio internal combustion engine, because the second control shaft is rotatably supported by the bearing including the split bearing bodies which are higher in rigidity than the housing, and because the bearing is directly fastened and fixed to the side wall of the main engine body by the fixing bolt, the housing can be made smaller and lighter in weight, and the support rigidity of the second control shaft can be improved.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
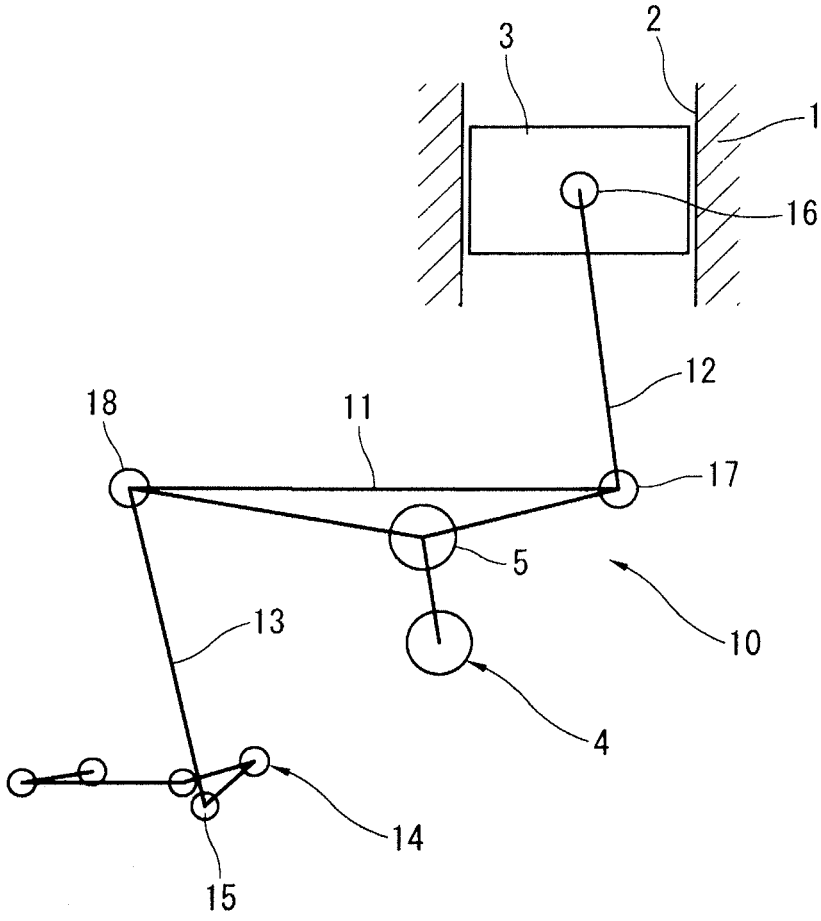
FIG. 1 is a diagrammatic diagram showing a simple depiction of an example of a variable compression ratio mechanism that is utilized in an internal combustion engine of the illustrated embodiments.

Referring initially to FIG. 1, a variable compression ratio mechanism using a multiple-link piston crank mechanism is diagrammatically illustrated that is used in connection with in a first embodiment. The variable compression ratio mechanism is a conventionally known mechanism, which is disclosed in various documents such as in Japanese Laid-Open Patent Publication No. 2004-257254 (U.S. Pat. No. 6,920,847). Thus, only a brief description of the variable compression ratio mechanism will be provided herein.

As seen in FIG. 1, a cylinder block 1 defines a plurality of cylinders 2 (only one shown). The cylinder block 1 constitutes part of a main engine body of an internal combustion engine. A piston 3 is slidably disposed in each of the cylinders 2. A crankshaft 4 is rotatably supported on the cylinder block 1 for moving the pistons 3 (only one shown) within the cylinders 2 (only one shown) in a reciprocating manner. The crankshaft 4 includes a plurality of crank pins 5 (only one shown).

Figure 2:
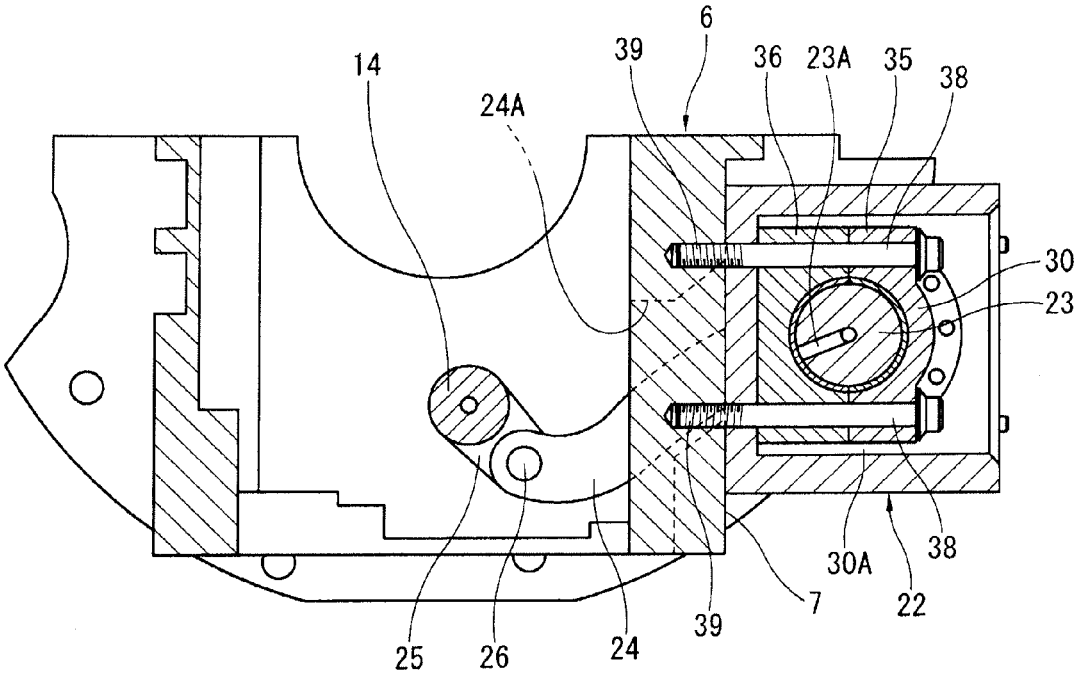
FIG. 2 is a cross-sectional view of the oil pan upper of the internal combustion engine showing the linking portion between the first control shaft and the second control shaft.

As seen in FIG. 2, an oil pan upper 6 is fixed to a bottom side of the cylinder block 1 (not shown in FIG. 2) in a conventional manner. The oil pan upper 6 constitutes a part of the main engine body. The oil pan upper 6 has a side wall 7 that is located on an intake side of the oil pan upper 6. The side wall 7 is also referred to below as an "oil pan side wall."

As seen in FIG. 1, a variable compression ratio mechanism 10 basically includes, for each of the cylinders 2, a lower link 11, an upper link 12 and a control link 13. As seen in FIG. 2, the variable compression ratio mechanism 10 also includes a first control shaft 14 with a plurality of control eccentric shaft parts 15 (i.e., one for each of the cylinders 2). The lower link 11 is rotatably attached to the crank pin 5 of the crankshaft 4. The upper link 12 links the lower link 11 and the piston 3 together. The first control shaft 14 is rotatably supported on the cylinder block 1 or another part of the main engine body. The control eccentric shaft parts 15 are eccentrically provided to the first control shaft 14. The control link 13 links the control eccentric shaft part 15 and the lower link 11 together. The piston 3 and the top end of the upper link 12 are linked via a piston pin 16 so as to be capable of rotating relative to each other. The bottom end of the upper link 12 and the lower link 11 are linked via an upper link-side linking pin 17 so as to be capable of rotating relative to each other. The top end of the control link 13 and the lower link 11 are linked via a control link-side linking pin 18 so as to be capable of rotating relative to each other. The bottom end of the control link 13 is rotatably attached to the control eccentric shaft part 15 described above.

Figure 3:
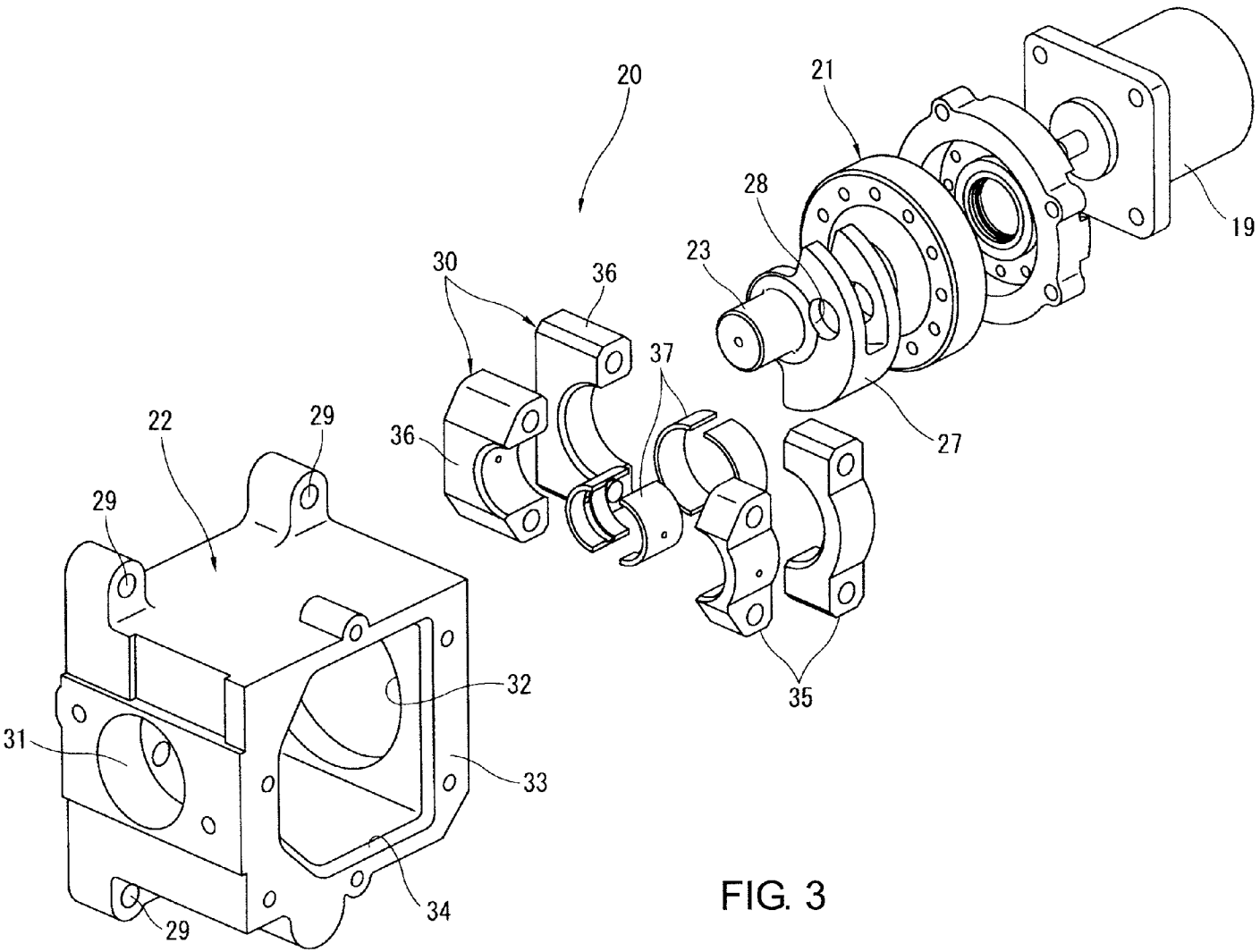
FIG. 3 is an exploded perspective view of the housing, the linking mechanism, the motor and other components of the internal combustion engine.

Referring to FIG. 3, an electric motor 19 is provided as an actuator of the variable compression ratio mechanism 10. The actuator is not limited to the electric motor 19, and can be a hydraulically driven actuator. The motor 19 is linked to the first control shaft 14 via a linking mechanism 20. Due to the rotational position of the first control shaft 14 being varied by the motor 19, piston stroke characteristics of the pistons 3 are changes. In particular, these changes of the piston stroke characteristics of the pistons 3 include the piston top dead center position and the piston bottom dead center position changing, as well as the engine compression ratio changing an the orientation of the lower link 11 changing. Therefore, the engine compression ratio can be controlled according to the operating state of the engine by driveably controlling the motor 19 via a controller (not shown).

Referring to FIGS. 2 and 3, the first control shaft 14 and the motor 19 are mechanically linked by the linking mechanism 20 which includes a decelerator 21. The first control shaft 14 is rotatably supported in the interior of the main engine body, which in the illustrated embodiment includes the cylinder block 1, the oil pan upper 6 and other components (not shown). In the illustrated embodiment, the motor 19 is disposed outside of the main engine body. More specifically, the motor 19 is attached to the engine-rear side of a housing 22 that is attached to the oil pan side wall 7, which is located on the intake side of the oil pan upper 6.

The decelerator 21 decelerates the rotation of the output shaft of the motor 19 and transfers the rotation to the first control shaft 14. In the illustrated embodiment, the decelerator 21 includes a Harmonic Drive™ mechanism. A description of the decelerator 21 is omitted herein because the structure of the decelerator 21 is the same as that disclosed in Japanese Patent Application No. 2011-259752. The decelerator 21 is not limited to a structure that uses such a Harmonic Drive™ mechanism. Rather, other types of gear ratio reduction mechanism can be used such as, for example, another form of decelerator, such as a cyclo decelerator, can be used.

The linking mechanism 20 includes a second control shaft 23, which is the output shaft of the decelerator 21. The second control shaft 23 is accommodated and rotatably disposed inside the housing 22. The second control shaft 23 extends alongside the oil pan side wall 7. The second control shaft 23 extends in the longitudinal direction of the engine (i.e. a direction parallel to the first control shaft 14). The first control shaft 14 is rotatably disposed inside the main engine body where lubricating oil scatters. The second control shaft 23 is provided outside of the main engine body. The first control shaft 14 and the second control shaft 23 are mechanically linked together by a lever 24. The lever 24 passes through an opening or slit 24A that is formed in the oil pan side wall 7. The housing 22 is laid alongside the oil pan side wall 7 so as to close off the slit 24A. The first control shaft 14 and the second control shaft 23 rotate in conjunction with each other via the lever 24.

As shown in FIG. 2, the lever 24 being pivotally coupled to both the first control shaft 14 and the second control shaft 23. In particular, the first control shaft 14 is provided with a first arm 25. The first control shaft 14 is pivotally linked to a first end of the lever 24 by a first linking pin 26 that is also pivotally coupled to a distal end of the first arm 25 of the first control shaft 14. The distal end of the first arm 25 extends outward in a radial direction from the first control shaft 14. Specifically, the distal end of the first arm 25 extends farther outward in the radial direction of the first control shaft 14 than an axial middle part of the first control shaft 14. The second control shaft 23 is provided with a second arm 27. The second control shaft 23 is pivotally linked to a second end of the lever 24 by a second linking pin (not shown) that is also pivotally coupled to a distal end of the second arm 27 of the second control shaft 23. In particular, as shown in FIG. 3, a pin hole 28 is formed in the second arm 27 for receiving the second linking pin (not shown) to pivotally connect the lever 24 to the distal end of the second arm 27 of the second control shaft 23. The distal end of the second arm 27 extends outward in a radial direction from the second control shaft 23. Specifically, the distal end of the second arm 27 extends farther outward in the radial direction than an axial middle part of the second control shaft 23.

The housing 22 has a hollow substantially rectangular parallelepiped shape. The side wall of the housing 22 near the oil pan side wall 7 is fastened and fixed to the oil pan side wall 7 by a plurality of bolts inserted through bolt holes 29 formed in this side wall, as shown in FIG. 3. The second control shaft 23 is accommodated and disposed in a rotatable manner inside the housing 22. The second control shaft 23 is rotatably supported by a pair of bearings 30 provided in the housing 22. The housing 22 has two circular insertion holes 31 and 32 through which the second control shaft 23 is inserted. The insertion holes 31 and 32 are opened in the engine-longitudinal side walls of the housing 22. An opposing wall 33 of the housing 22 opposes the oil pan side wall 7 from across the second control shaft 23. The opposing wall 33 has an operating window 34 opened therein. The operating window 34 is formed spanning through a large portion of the opposing wall 33 of the housing 22. The operation of inserting and fixing the bearing 30 into the housing 22 is performed through this operating window 34.

The bearings 30 are provided in two locations on both sides of the second arm 27, which is linked with the lever 24 (see FIG. 2), so as to sandwich the second arm 27 in the axial direction. The bearings 30 are configured as being divided by a pair of split bearing bodies 35 and 36 having a halved structure sandwiching the second control shaft 23. In this embodiment, both of the split bearing bodies 35 and 36 are configured as separate members from the housing 22. The split bearing bodies 35 and 36 are formed from an iron-based material that is higher in rigidity and strength than the housing 22, which is formed from an aluminum-based metal material of comparatively low rigidity and strength in order to keep weight and cost low. Between the bearing surfaces of the half cylinders of the split bearing bodies 35 and 36 and the external peripheral surface of the second control shaft 23 are half-cylindrical bearing metal sleeves 37. The bearing metal sleeves 37 are also formed from an iron-based material higher in rigidity and strength than the housing 22. A configuration in which the bearing metal sleeves 37 are omitted is also an option.

Figure 4:
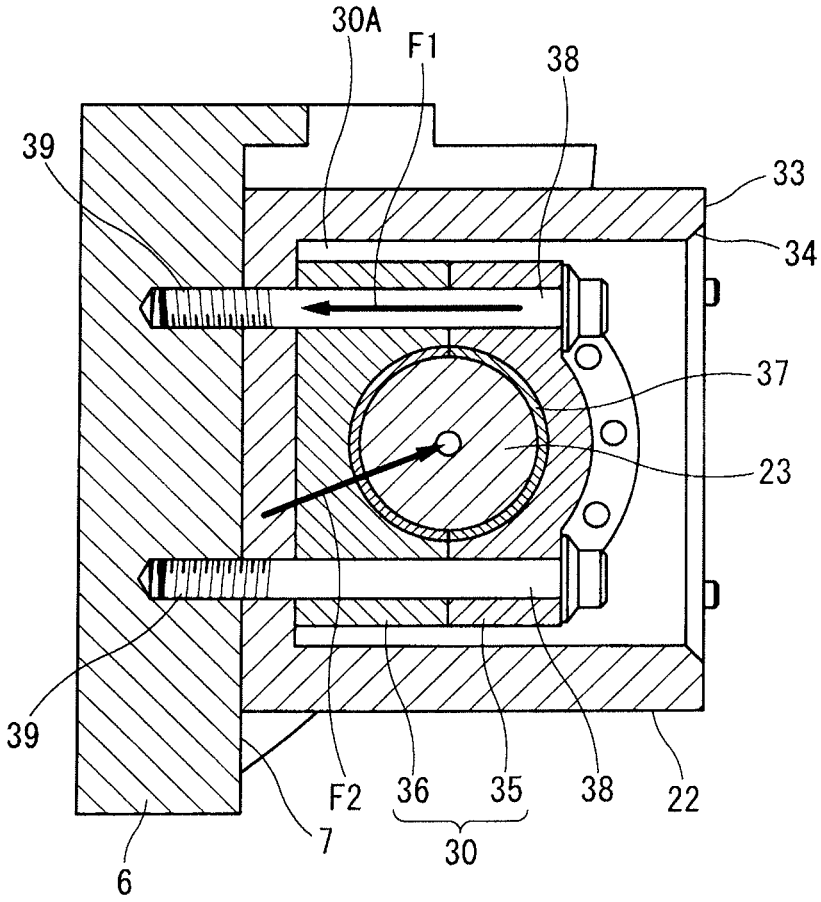
FIG. 4 is a cross-sectional view of a portion of the oil pan upper of the internal combustion engine where the housing and the bearing are fixed to the oil pan side wall.

The bearings 30 are fastened and fixed to the oil pan side wall 7 by a pair of fixing bolts 38 disposed on either side of the second control shaft 23, as shown in FIG. 4. The fixing bolts 38 are passed through both of the pair of split bearing bodies 35 and 36, passed through the side wall of the housing 22, and threaded into female threads 39 formed in the oil pan side wall 7. In this way, the split bearing bodies 35 and 36 and the housing 22 are securely fastening and fixing to the oil pan side wall 7. Accounting for deformation caused by the fixing operability and thermal expansion of the bearings 30, a suitable gap 30A is ensured between the outside surfaces of the bearings 30 and the inside wall surface of the housing 22.

Figure 5:
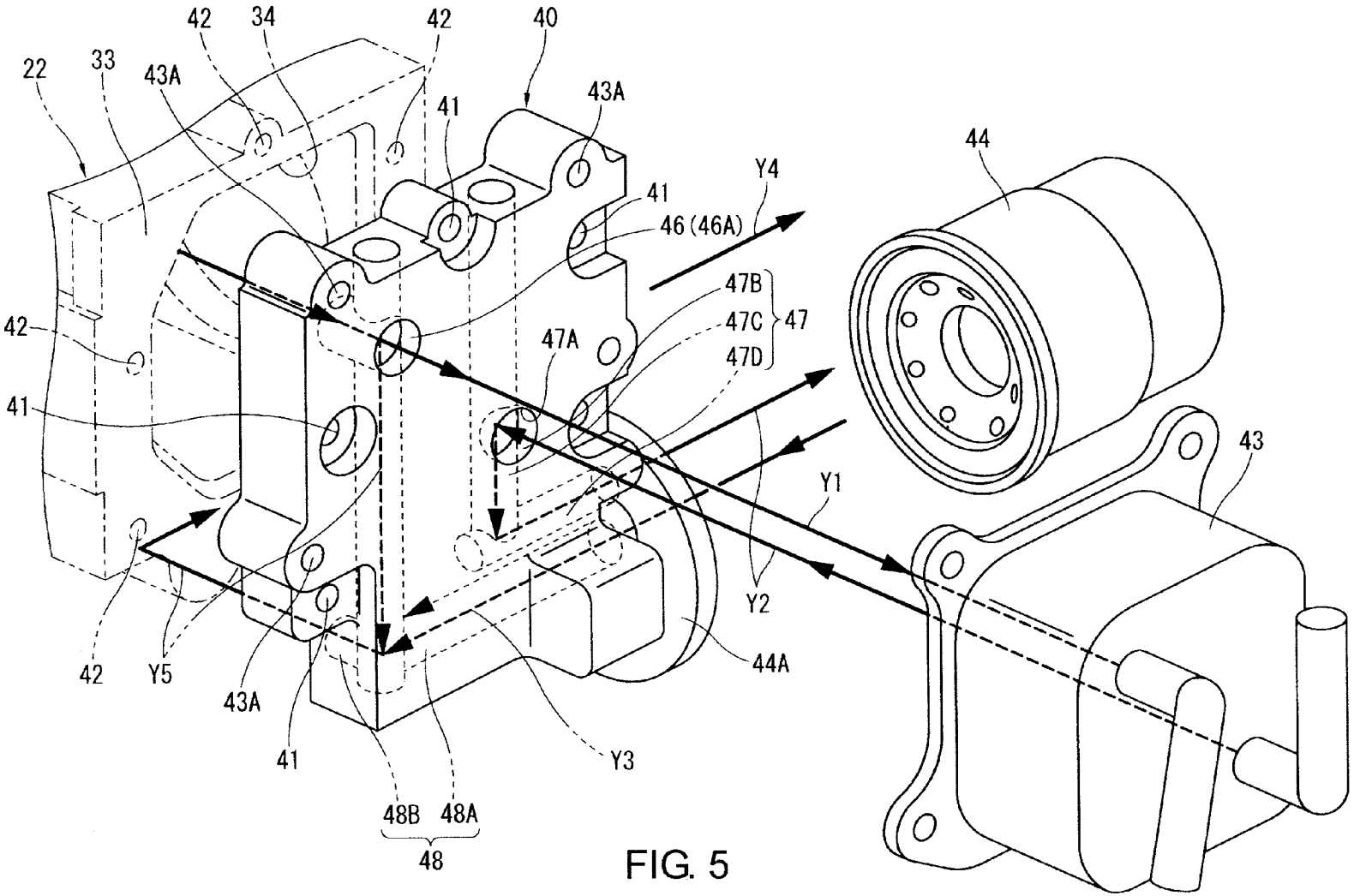
FIG. 5 is an exploded perspective view of a cover, an oil cooler, an oil filter, and other components of the internal combustion engine.

A plate-shaped cover 40 is fixed to the opposing wall 33 of the housing 22 in which the operating window 34 is opened, and the cover 40 is fixed so as to close up the operating window 34 using cover bolts (not shown) attached to bolt holes 41 an 42 formed in the cover 40 and the housing 22, as shown in FIG. 5. FIGS. 2 through 4 show a state in which the cover 40 has not yet been attached.

An oil cooler 43 is attached to the cover 40 for cooling oil (lubricating oil). Also an oil-purifying oil filter 44 is attached to the cover 40 for removing foreign matter from the oil. In other words, in addition to the motor 19 as an actuator, the oil cooler 43 and the oil filter 44 are also mounted in the housing 22 laid alongside the oil pan side wall 7.

The oil cooler 43 is fixed via cooler attachment bolts (not shown) to the side surface on the engine-widthwise outer side of the cover 40 functioning as a base for attaching the oil cooler 43, and bolt holes 43A in which the cooler attachment bolts are threaded are formed in the cover 40. Therefore, the oil cooler 43 is disposed so as to protrude outward in the engine width direction from the housing 22 and the cover 40.

The oil filter 44 is attached to a discoid oil filter attachment base 44A provided to the cover 40. Therefore, when installed in a vehicle, the oil filter 44 is disposed below the motor 19 attached to the engine-rear side of the housing 22, and more specifically is disposed parallel to the motor 19 in a position nearly directly below the motor 19.

Though not shown, an air-conditioning compressor is attached to the engine-front side in the vicinity of the oil pan side wall 7, a fastening flange to which the transmission is fastened is provided to the engine-rear side, and a space which is narrow in the engine-longitudinal direction and between the compressor and the flange is used to attach the motor 19, the linking mechanism 20 including the decelerator 21, the oil cooler 43, the oil filter 44, and other components all together to the oil pan side wall 7 via the housing 22.

Figure 6:
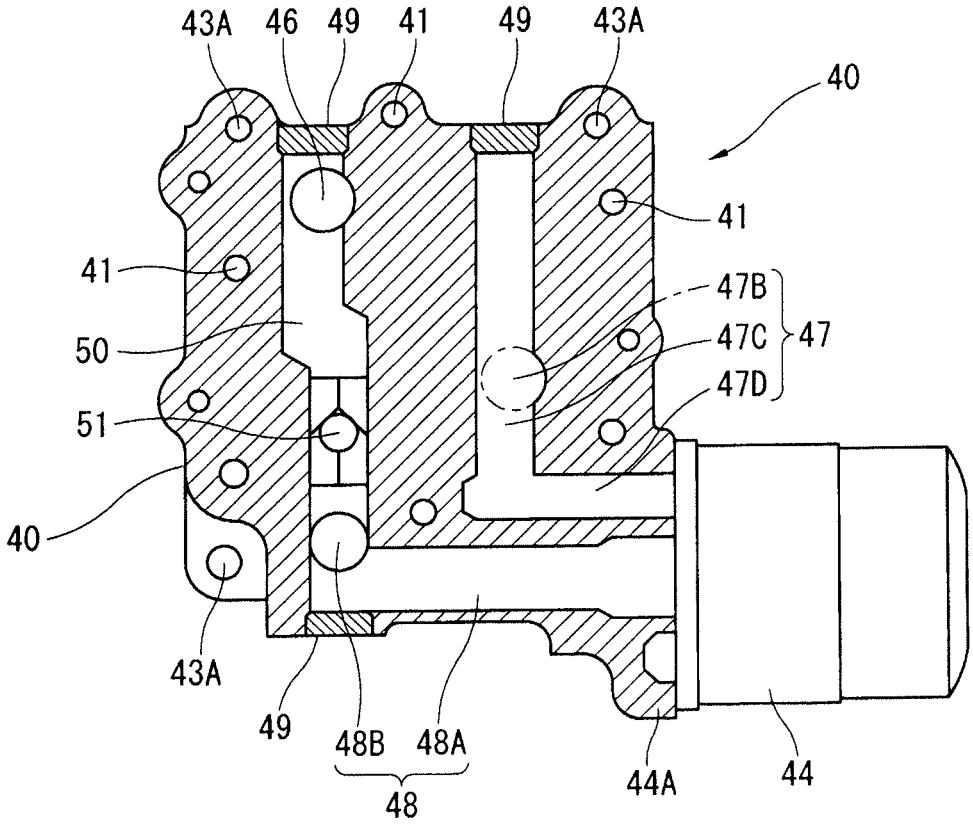
FIG. 6 is a cross-sectional view of the cover for showing the configuration of an oil channel inside of the cover.

Formed in the cover 40 are a plurality of oil channels for circulating oil to the oil cooler 43 and the oil filter 44, as shown in FIGS. 5 and 6. More specifically, the interior of the housing 22 is interconnected with the oil pan interior via the slit 24A (see FIG. 2) or the like, and to a certain extent the interior is filled with oil. A cooler supply oil channel 46 is formed in the cover 40 for supplying oil from the interior of the housing 22 to the oil cooler 43. The cooler supply oil channel 46 passes through in the plate thickness direction (a bolt fastening direction F1 of the fixing bolts 38 shown in FIG. 4). Also a cooler discharge oil channel 47 is formed in the cover 40 for discharging (supplying) oil from the oil cooler 43 to the oil filter 44. Also a filter discharge oil channel 48 is formed in the cover 40 for discharging oil from the oil cooler 43 to the interior of the housing 22. The cooler discharge oil channel 47 is defined by joining a plurality of long holes 47B to 47D formed in the side surface or end surface of the cover 40 by drilling or the like. The filter discharge oil channel 48 is similarly defined by joining a plurality of long holes 48A and 48B. Unnecessary open portions of the long holes are closed off by gaps 49 (see FIG. 6).

Furthermore, a bypass oil channel 50 is formed in the cover 40 for connecting the cooler supply oil channel 46 and the filter discharge oil channel 48. A relief valve 51 is provided to this bypass oil channel 50. The relief valve 51 is a check valve for preventing the flow of oil from the filter discharge oil channel 48 toward the cooler supply oil channel 46 and allowing only the flow of oil from the cooler supply oil channel 46 toward the filter discharge oil channel 48. The relief valve 51 is opened when the oil pressure in the cooler supply oil channel 46 exceeds a predetermined relief pressure.

Therefore, the oil supplied through the cooler supply oil channel 46 to the oil cooler 43 by the internal space of the housing 22 as shown by the arrow Y1 in FIG. 5 is subjected to heat exchange by the oil cooler 43 The oil is then supplied through the cooler discharge oil channel 47 to the oil filter 44 as shown by the arrows Y2, where foreign matter is removed by the oil filter 44. The oil is then passed through the filter discharge oil channel 48 and discharged to the internal space of the housing 22 as shown by the arrow Y3. The oil returned to the internal space of the housing 22 flows to the motor 19 disposed on the engine-rear side as shown by the arrow Y4. The oil is supplied as appropriate to the second control shaft 23 accommodated and disposed inside the housing 22, to the bearing portion of the output shaft of the motor 19, and to the sliding portion, and the oil is used for lubrication. A lubricating oil channel 23A or the like for supplying oil to the bearing portion is formed in the second control shaft 23 as shown in FIG. 2.

When oil circulation is poor due to clogging of the oil filter 44 or the like and the oil pressure in the cooler supply oil channel 46 exceeds the relief pressure, the relief valve 51 is opened. As a result, the oil supplied to the cooler supply oil channel 46 by the internal space of the housing 22 flows through the bypass oil channel 50 and the filter discharge oil channel 48 as shown by the arrow Y5 in FIG. 5. After which the oil is returned to the internal space of the housing 22, and the oil flows to the engine-rear side as shown by the arrow Y4. The oil is supplied as appropriate to the second control shaft 23 accommodated and disposed inside the housing 22 and to the bearing portion of the output shaft of the motor 19. The oil is used for lubrication.

The embodiment described above has an oil channel configuration in which oil flows sequentially to the oil cooler 43 and the oil filter 44, but another option is an oil channel configuration where the oil flows in the opposite direction, sequentially to the oil filter 44 and the oil cooler 43.

The following is a listing of the characteristic configuration and operational effects of the above embodiment and of other embodiments described hereinafter.

(1) The motor 19 having excellent responsiveness and control precision is used as the actuator of the variable compression ratio mechanism 10, and the motor 19 is disposed on the outside of the main engine body so that oil does not scatter on the motor 19. The motor 19 is attached to the oil pan side wall 7 on the air intake side in order to protect the motor 19 from exhaust heat. The motor 19 and the first control shaft 14 are mechanically linked by the linking mechanism 20 which includes the decelerator 21. The second control shaft 23 of the linking mechanism 20 is disposed so as to extend along the oil pan side wall 7, and the second control shaft 23 and the first control shaft 14 are mechanically linked by the lever 24 which is inserted through the slit 24A formed in the oil pan side wall 7. The second control shaft 23 is accommodated and disposed inside the housing 22 attached to the oil pan side wall 7, and the bearings 30 for rotatably supporting the second control shaft 23 are provided to the housing 22. In such a structure, the following new Problems 1 to 4 have been discovered.

Problem 1—Components such as the housing 22 and motor 19 attached to the oil pan side wall 7 on the air intake side must be disposed in a narrow space between the air-conditioning compressor and the transmission fastening flange as described above, and the dimension in the engine-longitudinal direction is therefore severely limited. Particularly in the case of an internal combustion engine comprising a supercharger, because the oil cooler 43 is provided in addition to the oil filter 44, and also because (not shown) the oil pump and main gallery are disposed on the air intake side of the cylinder block and the oil pan upper above the oil pan. The above-described oil filter 44 and oil cooler 43 is also disposed together with the housing 22 and the like in the vicinity of the oil pan side wall 7 on the air intake side. Therefore, the housing 22 is preferably made smaller and particularly reduced in size in the engine-longitudinal dimension. When the bearing width of the second control shaft 23 accommodated and disposed inside the housing 22 is reduced by this requirement to reduce the engine-longitudinal dimension of the housing 22, the bearing surface pressure increases and wearing of the bearing portion becomes a problem. When the axial diameter of the second control shaft 23 is increased as a measure to counter the wearing of the bearing portion of the second control shaft 23, there is a greater range of fluctuation in the clearance between the second control shaft 23 and the bearing portion resulting from thermal expansion and the like. Also there is a risk of the clearance increasing and causing worse sound vibration during high temperatures. Further, because the clearance is reduced and friction increases during low temperatures, there is a risk that variations in the engine compression ratio at times such as low temperature startup will create an adverse effect.

Problem 2—When the support rigidity of the motor 19 (the actuator) relative to the oil pan side wall 7 is low, there is resonance in the motor 19, and there is a risk that sound vibration performance will worsen and vibration-resistance performance will worsen.

Problem 3—As described above, because a large combustion load or inertial load repeatedly acts on the side of the second control shaft 23 from the side of the first control shaft 14 of the variable compression ratio mechanism 10 while the engine is operating, there must be high support rigidity in the housing 22 and for the bearings 30 accommodating and supporting the second control shaft 23. Therefore, the housing 22 is likely to increase in size and weight.

Problem 4—When the clearance of the bearing portion of the second control shaft 23 is increased by thermal expansion or the like, non-uniformity in the engine compression ratio increases, and the errors in the engine compression ratio are larger. In this case, the engine compression ratio must be set lower than an appropriate compression ratio to allow for errors, which brings about worsening of fuel consumption and a decrease in torque and output, accompanying the decrease in the engine compression ratio.

In view of these problems 1 to 4, the following characteristic configuration is used in the present embodiment. Specifically, the bearings 30 provided to the housing 22 are configured as being divided by the pair of split bearing bodies 35 and 36 having a halved structure holding the second control shaft 23 in between, and these split bearing bodies 35 and 36 (and the bearing metals 37) are configured as separate members formed from an iron-based metal material of higher rigidity and strength than the housing 22 made of an aluminum alloy. The split bearing bodies 35 and 36 are directly fastened and fixed to the oil pan side wall 7 by the fixing bolts 38. In other words, the fixing bolts 38 directly fasten and fix the bearings 30 and the oil pan side wall 7 together by being passed through both of the pair of split bearing bodies 35 and 36 and threaded into the female threads 39 formed in the oil pan side wall 7. The effects 1 to 3 below are obtained by this configuration.

Effect 1—Because of this structure in which the bearings 30 of higher rigidity than the housing 22 are directly fastened and fixed by the fixing bolts 38 to the oil pan side wall 7 which is part of the main engine body, the bearings 30 can be securely fixed to the oil pan side wall 7 without relying on the rigidity or strength of the housing 22. Therefore, the support rigidity of the second control shaft 23 greatly improves, and fluctuations in the engine compression ratio can be suppressed.

Effect 2—A large part of the combustion load and inertia load repeatedly imposed by the side having the variable compression ratio mechanism 10 are transferred to and exerted on the oil pan side wall 7 from the second control shaft 23 via the bearings 30 and the fixing bolts 38, and loads are not directly transferred to or exerted on the housing 22. Because the loads exerted on the housing 22 are thus reduced, deformation of the housing 22 is suppressed, and the housing 22 can be reduced in size and weight. Specifically, the housing 22 can be reduced in weight and cost by making the housing 22 from an aluminum alloy.

Effect 3—Because the strength of the bearings 30 is greater than the housing 22, there is less deformation and caving in of the bolt bearing surfaces in which the heads of the fixing bolts 38 are embedded. Therefore, the bolt bearing surfaces can be reduced in diameter without inducing deformation or caving in of the bolt bearing surfaces, and the bearing widths can be shortened without inducing a decrease in support rigidity due to a decrease in bolt axial force. The engine-longitudinal dimensions of the bearings 30 can therefore be shortened, the axial dimension of the second control shaft 23 can consequently be shortened to shorten the engine-longitudinal dimension of the housing 22, and the ease of engine installation can be improved.

(2) Because the bearings 30 are formed from an iron-based metal material similar to the second control shaft 23, the difference in thermal expansion coefficients between the second control shaft 23 and the bearings 30 is less than the difference in thermal expansion coefficients between the bearings 30 and the housing 22 formed from an aluminum-based metal material. Therefore, it is possible to suppress fluctuation in the clearance between the external peripheral surface of the second control shaft 23 and the bearing surfaces of the bearings 30 (the bearing metals 37) caused by differences in the amount of deformation from thermal expansion, and it is possible to suppress the loss of sound vibration performance due to a clearance increase as well as the increase in friction due to a clearance reduction.

Due to the use of iron-based bearings 30, there is less of a difference in thermal expansion coefficients between the bearings 30 and the fixing bolts 38 which are also formed from an iron-based metal material. Therefore, it is possible to suppress any decrease in bolt axial strength caused by differences in the amount of deformation from thermal expansion, deformation and caving in of the bolt bearing surfaces during high temperatures can be suppressed, and aperture widening of the bolt fastening surfaces during low temperatures can be suppressed.

(3) The fixing bolts 38 for the bearings are passed through the side walls of the housing 22 interposed between the bearings 30 and the oil pan side wall 7, and the side walls of the housing 22 are fastened and fixed to the oil pan side wall 7 together with the bearings 30.

Thus, due to the structure in which the bearings 30 are fastened to the oil pan side wall 7 with the side walls of the housing 22 therebetween, the housing 22 is fixed to the oil pan side wall 7 in these portions as well, there are more fastening points between the housing 22 and the oil pan side wall 7, the support rigidity of the housing 22 therefore improves, and consequently the support rigidity of the actuator (the motor 19) attached to the housing 22 improves as well. Therefore, vibration in the actuator can be suppressed to suppress worsening of the sound vibration performance, and the durability of the actuator can be improved.

(4) As shown in FIG. 4, the fastening direction L1 of the fixing bolts 38 is set so as to be the opposite direction facing the other way from the acting direction L2 of a maximum combustion load paralleling the link center line of the lever 24, i.e., a direction opposite by about 180 degrees. The combustion load acting on the bearings 30 from the second control shaft 23 can thereby be directly borne by the oil pan side wall 7 via the fixing bolts 38, and the load acting on the housing 22 can therefore be further reduced.

Figure 7:
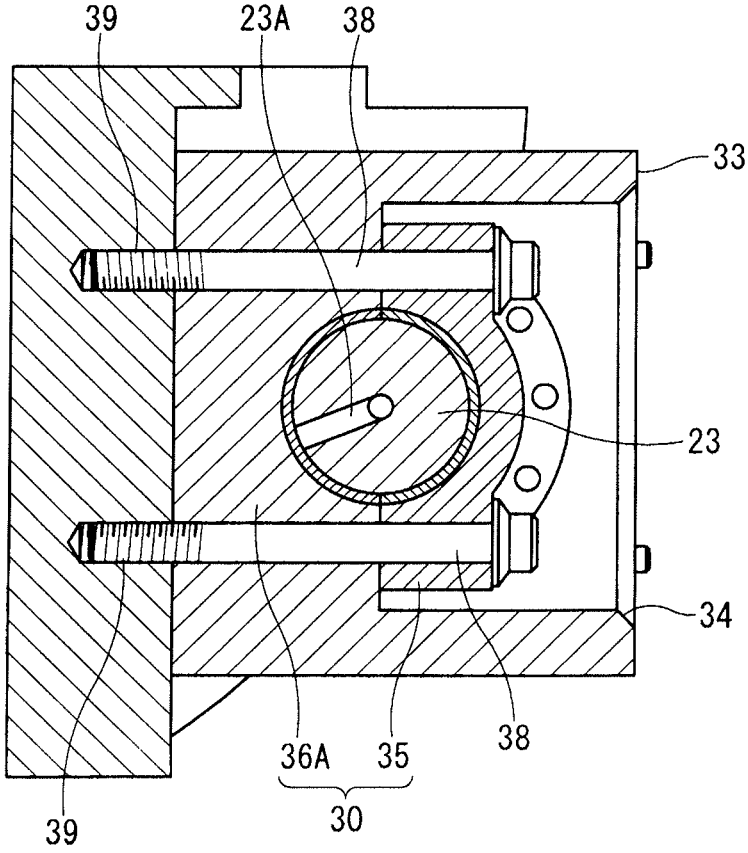
FIG. 7 is a cross-sectional view, similar to FIG. 4, of a portion of the oil pan upper of the internal combustion engine where the housing and the bearing are fixed to the oil pan side wall according to another embodiment.

(5) Both of the pair of split bearing bodies 35 and 36 constituting the bearings 30 in the embodiment described above are configured as separate iron-based members of higher rigidity than the housing 22 but are not limited as such, and another option is that a split bearing body 36A, which between the pair of split bearing bodies 35 and 36A constituting the bearings 30 is the nearer to the oil pan side wall 7, be formed integrally and unitarily with the housing 22 in order to reduce the number of components and simplify the structure, as is the case in another embodiment shown in FIG. 7.

Because the maximum combustion load acts on the oil pan side wall 7 mostly via the split bearing body 35 and the fixing bolt 38 that are farther from the oil pan side wall 7, the maximum combustion load does not directly act on the split bearing body 36A that is nearer to the oil pan side wall 7. Therefore, no severe loss of support rigidity is brought about regardless of the split bearing body 36A nearer to the oil pan side wall 7 being integrally formed on the housing 22 which is relatively low in rigidity and strength.

Because the split bearing body 35 further from the oil pan side wall 7 where the maximum combustion load acts is a separate member from the housing 22 and is formed from a material of higher rigidity and strength than the housing 22, sufficient rigidity and strength against the maximum combustion load can be ensured, and surface pressure in the bolt bearing surfaces can be ensured.

(6) In the case of a structure in which the bearings 30 are fastened and fixed to the oil pan side wall 7 by the fixing bolts 38 as described above, the operating window 34 large enough for the bearings 30 to be inserted and fixed must be opened and formed in the housing 22, in the opposing wall 33 that faces the oil pan side wall 7 across the second control shaft 23 disposed along the oil pan side wall 7. The plate-shaped cover 40 is attached to the opposing wall 33 of the housing 22 and the operating window 34 is liquid-tightly closed up by the cover 40 so that the oil in the housing 22 does not leak out through the operating window 34. The oil cooler 43 for cooling the oil is mounted to the cover 40 for closing up the operating window.

Thus, the cover 40 can also be used as a base for attaching the oil cooler 43 in addition to closing up the operating window 34. By using the cover 40 as a base, the structure can be simplified by reducing the number of components, and the oil cooler 43 can be disposed all together in the vicinity of the housing 22, allowing the ease of installing the engine to be improved.

(7) The cooler supply oil channels 46 for supplying oil to the oil cooler 43 and the cooler discharge oil channel 47 for discharging oil from the oil cooler 43 are formed in the cover 40. Thus, the oil channels 46 and 47 can be shortened and simplified by forming the oil channels for circulating oil to the oil cooler 43 in the cover 40 for closing up the operating window.

An oil cooler entrance 46A, which is one end of the cooler supply oil channel 46, and an oil cooler exit 47A, which is one end of the cooler discharge oil channel 47, are opened and formed in the side surface of the cover 40 to which the oil cooler 43 is attached. The oil channels are formed so that the distance from the oil cooler entrance 46A to the motor 19 as the actuator is longer than the distance from the oil cooler exit 47A to the motor 19, as shown in FIG. 5. In other words, the oil cooler exit 47A is disposed nearer to the rear of the engine, where the motor 19 is disposed, than the oil cooler entrance 46A.

With such a configuration, the motor 19 can be prevented from reaching high temperatures by distancing the cooler supply oil channel 46, which includes the oil cooler entrance 46A through which high-temperature oil flows, from the motor 19, and disposing the cooler discharge oil channel 47, which includes the oil cooler exit 47A through which low-temperature oil flows, in proximity to the motor 19. Therefore, there are fewer opportunities in which the action of the motor 19 is limited in order to prevent overheating of the motor 19, i.e., there can be fewer opportunities to reduce the engine compression ratio to a ratio such that the angle position of the first control shaft 14 can be held without using the holding force of the motor 19, and the resulting worsening of fuel consumption can therefore be suppressed.

(8) Furthermore, the oil filter 44 is attached to the cover 40 for purifying the oil. Thereby, the cover 40 for closing up the operating window can also be used as a base for attaching the oil filter 44, the structure can be simplified by further reducing the number of components, and the ease of installing the engine can be further improved by disposing the oil filter 44 all together in the vicinity of the housing 22.

(9) The filter discharge oil channel 48 for discharging oil from the oil filter 44, and the bypass oil channel 50 joining the cooler supply oil channel 46 and the filter discharge oil channel 48 together, are formed in the cover 40, and the bypass oil channel 50 is provided with the relief valve 51 for allowing only the flow of oil from the cooler supply oil channel 46 to the filter discharge oil channel 48.

Therefore, even when the flow of oil circulating through the oil filter 44 is poor due to clogging of the oil filter 44 or the like, the oil then flows via the bypass oil channel 50, and a supply of oil can be ensured to the bearing portions of the output shaft of the motor 19 and the second control shaft 23 accommodated inside the housing 22.

(10) The oil filter 44 is disposed below and parallel to the motor 19 disposed to the rear of the housing 22, as shown in FIGS. 3 and 5. Thus, due to the oil filter 44 being disposed in proximity to the motor 19 which is smaller than the housing 22 accommodating the decelerator 21 and other components, the oil filter 44 can be disposed in a comparatively higher position, i.e. farther from the ground than when the oil filter 44 is disposed below the housing 22, and interference with the road surface and kicked up gravel from the road surface are therefore easily avoided.

Due to the oil filter 44 being disposed in the bottom of the motor 19 and direct contact being suppressed or avoided between the motor 19 and harness (particularly the resinous connecting portion) and the road surface, the motor 19 can be protected from kicked up gravel and the like. Even if oil leaks out from the oil filter 44, oil can be prevented from scattering onto the motor 19 because the motor 19 is positioned higher than the oil filter 44.

While only selected embodiments have been chosen to illustrate the present invention, it will be apparent to those skilled in the art from this disclosure that various changes and modifications can be made herein without departing from the scope of the invention as defined in the appended claims. For example, the structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A variable compression ratio internal combustion engine comprising:

a main engine body;

a housing attached to a side wall of the main engine body;

a variable compression ratio mechanism configured to vary an engine compression ratio according to a rotational position of a first control shaft that is rotatably disposed inside the main engine body;

an actuator disposed outside of the main engine body and configured to vary and maintain the rotational position of the first control shaft; and a linking mechanism linking the actuator to the first control shaft, the linking mechanism being at least partially disposed outside of the main engine body and including a second control shaft rotatably supported to the housing by a bearing to rotate in conjunction with the first control shaft, the bearing including a pair of split bearing bodies having a halved structure that rotatably holds the second control shaft therebetween, and at least the split bearing body that is farther from the main engine body being configured as a separate member that is higher in rigidity than the housing; and the bearing being fixed to the side wall of the main engine body by fixing bolts that pass through both of the split bearing bodies and thread into the side wall of the main engine body.

2. The variable compression ratio internal combustion engine according to claim 1, wherein a difference in thermal expansion coefficients of the second control shaft and the bearing is less than a difference in thermal expansion coefficients of the bearing and the housing.

3. The variable compression ratio internal combustion engine according to claim 1, wherein the fixing bolts also pass through a portion of the housing that is disposed between the bearing and the side wall of the main engine body to secure both the housing and the bearing to the side wall of the main engine body.

4. The variable compression ratio internal combustion engine according to claim 1, wherein the fixing bolts have a fastening direction that is opposite to an acting direction in which a combustion load acts from the first control shaft toward the second control shaft.

5. The variable compression ratio internal combustion engine according to claim 1, wherein the split bearing body of the bearing that nearer to the side wall of the main engine body is integrally formed as a unitary part of the housing.

6. The variable compression ratio internal combustion engine according to claim 1, wherein the second control shaft is disposed along the side wall of the main engine body, the housing has an operating window in an opposing wall of the housing which faces the side wall of the main engine body across the second control shaft, and the housing has a cover that is attached to the opposing wall of the housing to close the operating window, the cover has an oil cooler attached thereto.

7. The variable compression ratio internal combustion engine according to claim 6, wherein the cover includes a cooler supply oil channel for supplying oil to the oil cooler and a cooler discharge oil channel for discharging oil from the oil cooler, the cooler supply oil channel has an oil cooler entrance and an oil cooler exit that are formed in a side surface of the cover to which the oil cooler is attached with the actuator being spaced from the oil cooler entrance by a distance greater than a distance from the oil cooler exit to the actuator.

8. The variable compression ratio internal combustion engine according to claim 7, further comprising an oil filter is attached to the cover.

9. The variable compression ratio internal combustion engine according to claim 8, wherein the cover includes a filter discharge oil channel for discharging oil from the oil filter and a bypass oil channel for joining the cooler supply oil channel and the filter discharge oil channel together, the bypass oil channel is provided with a relief valve for allowing only oil to flow from the cooler supply oil channel to the filter discharge oil channel.

10. The variable compression ratio internal combustion engine according to claim 9, wherein the actuator is attached to one side of the housing with respect to the engine-longitudinal direction; and the oil filter is disposed below and parallel to the actuator on the one side of the housing having the actuator attached thereto.

11. The variable compression ratio internal combustion engine according to claim 8, wherein the actuator is attached to one side of the housing with respect to the engine-longitudinal direction; and the oil filter is disposed below and parallel to the actuator on the one side of the housing having the actuator attached thereto.

12. The variable compression ratio internal combustion engine according to claim 2, wherein the fixing bolts also pass through a portion of the housing that is disposed between the bearing and the side wall of the main engine body to secure both the housing and the bearing to the side wall of the main engine body.

13. The variable compression ratio internal combustion engine according to claim 2, wherein the fixing bolts have a fastening direction that is opposite to an acting direction in which a combustion load acts from the first control shaft toward the second control shaft.

14. The variable compression ratio internal combustion engine according to claim 2, wherein the split bearing body of the bearing that nearer to the side wall of the main engine body is integrally formed as a unitary part of the housing.

15. The variable compression ratio internal combustion engine according to claim 2, wherein the second control shaft is disposed along the side wall of the main engine body, the housing has an operating window in an opposing wall of the housing which faces the side wall of the main engine body across the second control shaft, and the housing has a cover that is attached to the opposing wall of the housing to close the operating window, the cover has an oil cooler attached thereto.

16. The variable compression ratio internal combustion engine according to claim 15, wherein the cover includes a cooler supply oil channel for supplying oil to the oil cooler and a cooler discharge oil channel for discharging oil from the oil cooler, the cooler supply oil channel has an oil cooler entrance and an oil cooler exit that are formed in a side surface of the cover to which the oil cooler is attached with the actuator being spaced from the oil cooler entrance by a distance greater than a distance from the oil cooler exit to the actuator.

17. The variable compression ratio internal combustion engine according to claim 16, further comprising an oil filter is attached to the cover.

18. The variable compression ratio internal combustion engine according to claim 17, wherein the cover includes a filter discharge oil channel for discharging oil from the oil filter and a bypass oil channel for joining the cooler supply oil channel and the filter discharge oil channel together, the bypass oil channel is provided with a relief valve for allowing only oil to flow from the cooler supply oil channel to the filter discharge oil channel.

19. The variable compression ratio internal combustion engine according to claim 18, wherein the actuator is attached to one side of the housing with respect to the engine-longitudinal direction; and the oil filter is disposed below and parallel to the actuator on the one side of the housing having the actuator attached thereto.

20. The variable compression ratio internal combustion engine according to claim 17, wherein the actuator is attached to one side of the housing with respect to the engine-longitudinal direction; and the oil filter is disposed below and parallel to the actuator on the one side of the housing having the actuator attached thereto.

* * * * *